United States Patent [19]

Petersen

[11] 4,124,251

[45] Nov. 7, 1978

[54] MODULAR FURNITURE CONSTRUCTION

[75] Inventor: Warren D. Petersen, St. Charles, Ill.

[73] Assignee: Burd, Inc., Howell Division, St. Charles, Ill.

[21] Appl. No.: 835,017

[22] Filed: Sep. 20, 1977

[51] Int. Cl.[2] ..... A47C 1/12

[52] U.S. Cl. ..... 297/445; 297/218; 297/419; 297/440; 297/463

[58] Field of Search ..... 297/218, 419, 420, 422, 297/440, 445, 446, 463

[56] References Cited

U.S. PATENT DOCUMENTS

| | | | |
|---|---|---|---|
| 1,854,663 | 4/1932 | Nebel | 297/440 X |
| 2,612,213 | 9/1952 | Bott | 297/218 X |
| 2,638,971 | 5/1953 | Furman | 297/463 |
| 2,678,088 | 5/1954 | Jamison | 297/440 UX |
| 3,137,527 | 6/1964 | Hoven et al. | 297/422 X |
| 3,301,597 | 1/1967 | Bereday | 297/445 X |
| 3,663,059 | 5/1972 | Omlie | 297/44 D |
| 3,719,389 | 3/1973 | Burton et al. | 297/445 X |

*Primary Examiner*—James C. Mitchell

*Attorney, Agent, or Firm*—Hill, Gross, Simpson, Van Santen, Steadman, Chiara & Simpson

[57] ABSTRACT

A modular system of furniture components avoiding the necessity for cumbersome, heavy frames, has end leg modules connected by seat and back modules with finished panel modules mounted on the outer sides of the leg modules. The seat and back modules have rigid frames mounted on ledges of the end leg modules. The back module frame is also secured near its top to the end leg modules. The end panels seat within the end legs to cover the ends of the seat and back modules. The seat, back, and end panel modules can be upholstered and designed as desired and the module components can be shipped in a knocked down condition to be easily assembled at the point of use.

20 Claims, 9 Drawing Figures

Fig. 1
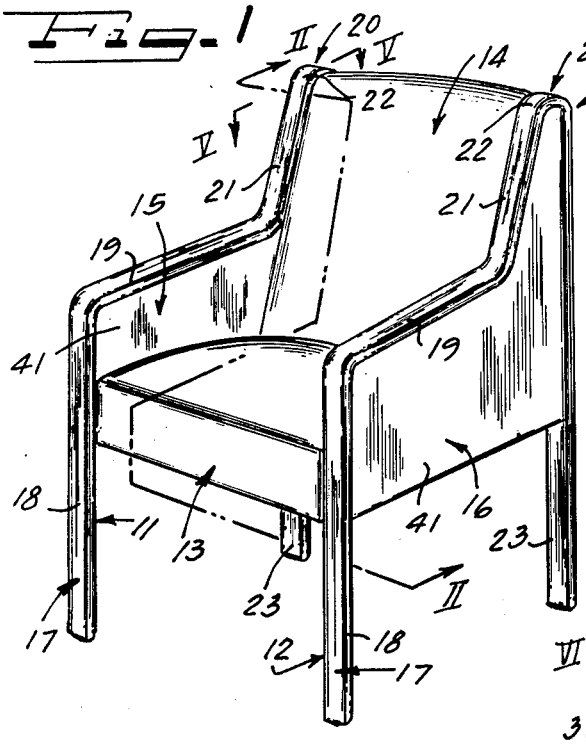
Fig. 2
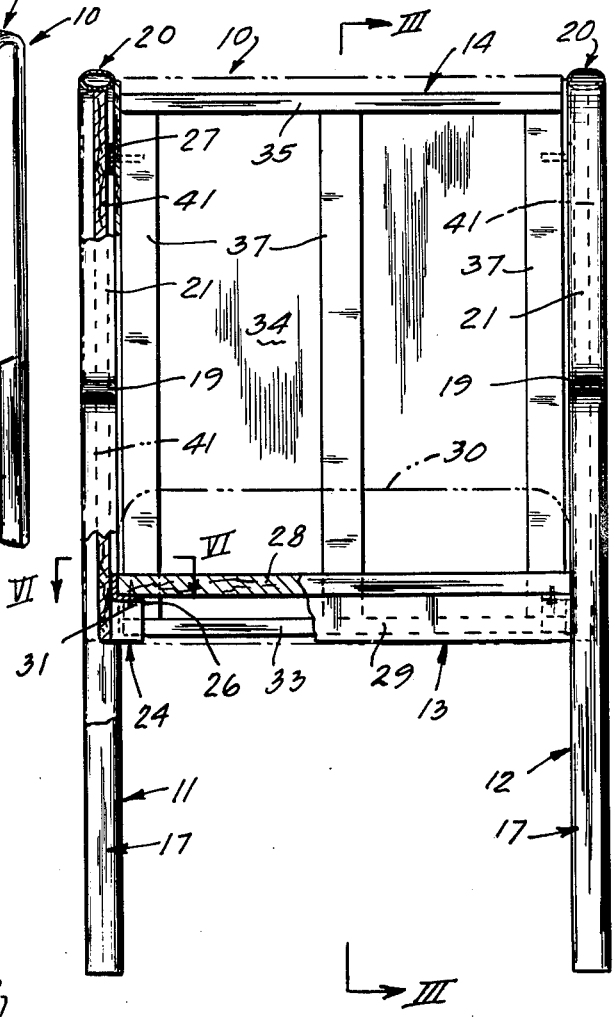
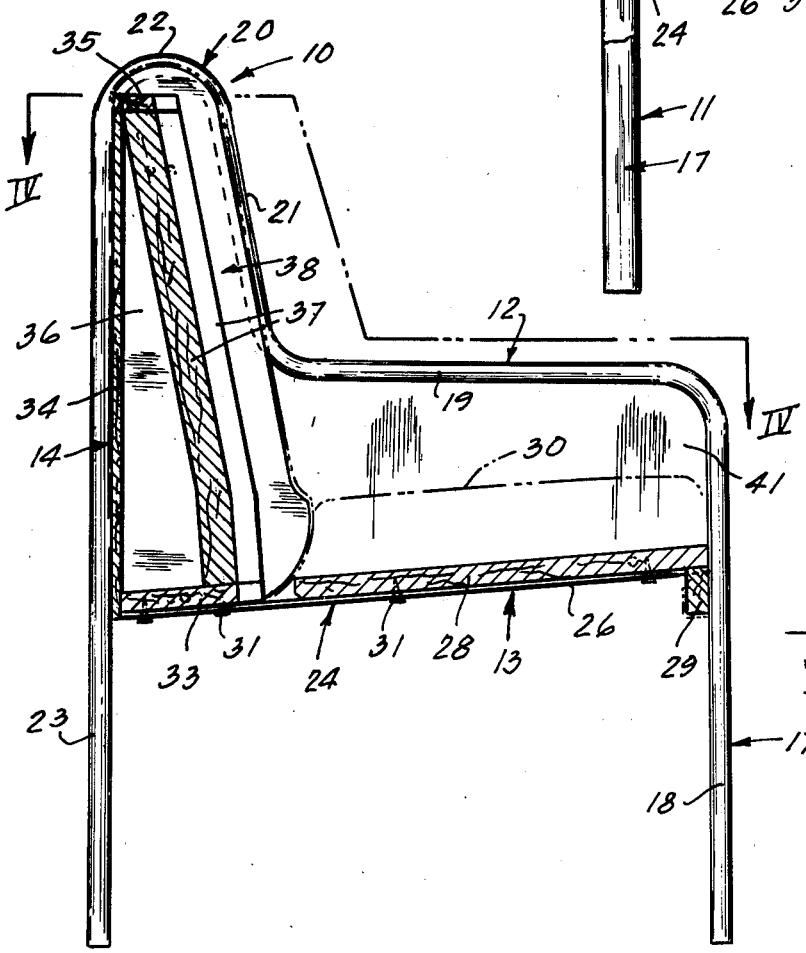
Fig. 3

Fig. 4
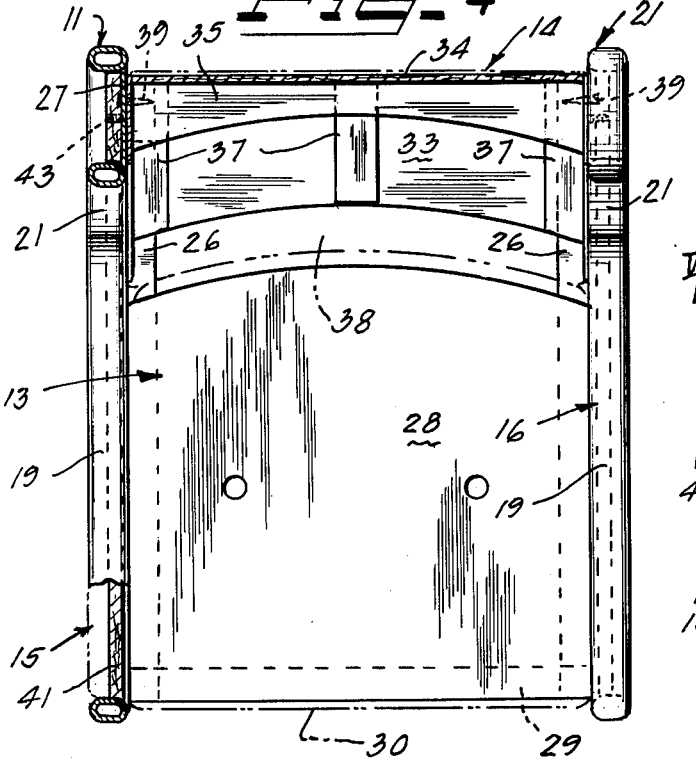
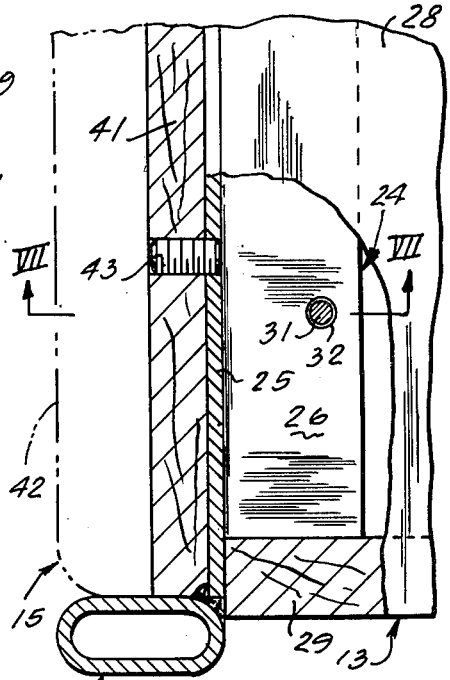
Fig. 6
Fig. 5
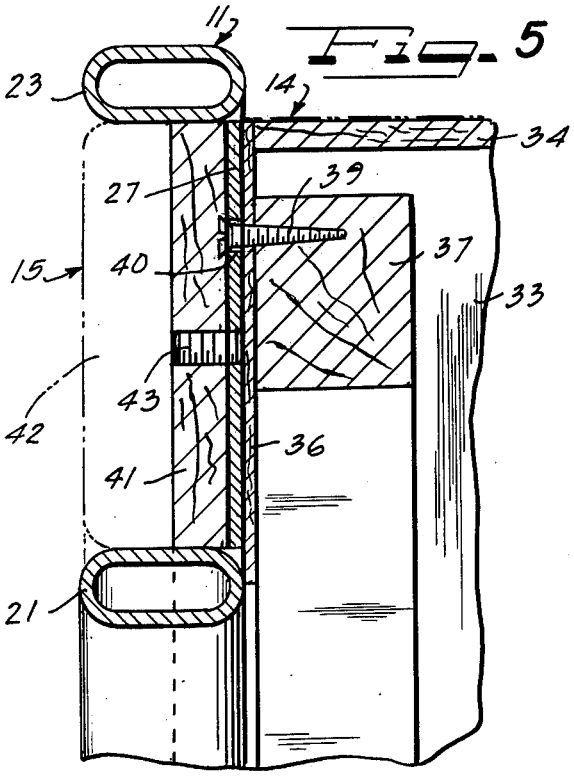
Fig. 7
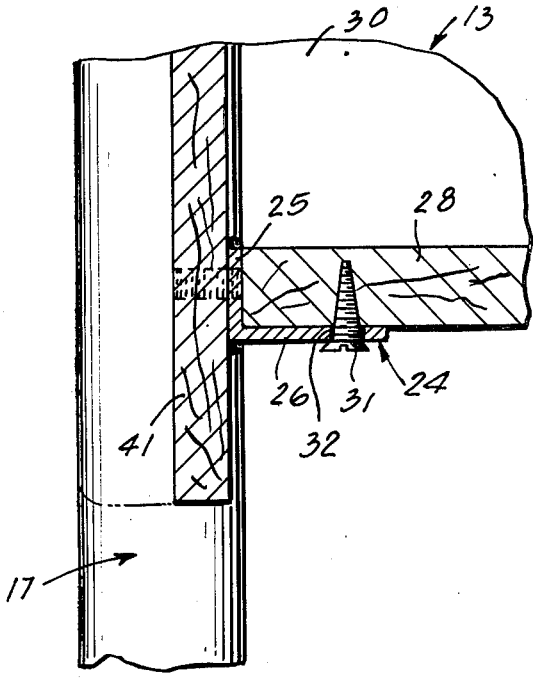

MODULAR FURNITURE CONSTRUCTION

FIELD OF THE INVENTION

This invention relates to the art of furniture construction and deals particularly with a modular chair construction composed of end frames, seat and back frames, and end panels which can be shipped in knocked down condition and easily assembled at the point of display or use.

PRIOR ART

Furniture is generally constructed with a rigid, heavy, cumbersome frame supporting upholstered seat and back portions. The frame usually has rigidly connected leg portions providing a base for the upholstered portions and is not only cumbersome and heavy but is also susceptible to deformation as by twisting and the like. The upholstered sections are usually supported on runners between the end leg portions and have finished exposed ends.

SUMMARY OF THIS INVENTION

According to this invention, there is now provided a modular furniture construction, particularly suited for chairs and davenports where end leg modules are connected through back and seat frame modules and have end panel modules covering the ends of the seat and frame modules. The end frame modules are formed from bent tubing providing spaced front and rear legs connected by an upright looped back portion and a forwardly extending horizontal portion which can serve as an arm rest. An angle strip is secured at tis ends to the leg portions of each end frame and spans the space between the leg portions below the horizontal portion of the tubing. One leg of the angle strip on each frame projects toward the other frame providing a ledge on which are mounted rigid seat and back frames which can be upholstered as desired. The back frame is also secured to a bracket spanning the legs of the upright looped back portion of the frame near the top thereof. End panels which can be upholstered or fininshed as desired fit within the confines of the bent tubing forming the end frames and are secured to the angle strips and brackets.

The components forming the construction can be shipped in a knocked down stacked compact condition and easily assembled by means of fasteners such as screws which are easily applied by unskilled workers or householders.

Since the end leg frame modules are only connected by the spanning back and seat frames, and heretofore required cross frames or runners are eliminated, misalignments and twisting of the frame relative to the seat and back are completely eliminated. Thus, the legs of the end frame modules will always rest firmly and evenly on the floor.

The seat frame, the back frame, and the end panels can be upholstered or otherwise finished as desired thus making available various combinations to suit the buyer and provide an in situ custom-made chair or davenport.

The tubing forming the end frames can be bent into different shapes thus, for example, providing a chair with raised arm rests or with sides that are flush with or below the seat.

It is then an object of this invention to provide a modular chair or davenport construction free from cumbersome framework and having components that can be stacked flat for easy assembly at the point of display or use.

Another object of this invention is to provide a chair with end frame modules connected by back and seat units.

A still further object of this invention is to provide an article of furniture with metal tube end frames connected by spanning back and seat modules and finished with end panels nested in the tubular configuration.

A specific object of the invention is to provide a chair with bent tube end frames each having front and rear legs connected by an upright looped back portion and forwardly extending portion with ledges spanning the legs and supporting back and seat modules.

A still further object of the invention is to provide a six component modular chair construction that is easily assembled at the point of display or use.

Other and further objects of this invention will become apparent to those skilled in this art from the following detailed description of the annexed sheets of drawings which, by example only, illustrate two embodiments of the invention.

ON THE DRAWINGS

FIG. 1 is a front and side perspective view of a chair construction of this invention;

FIG. 2 is a cross sectional view of the chair of FIG. 1 taken generally along the line II—II of FIG. 1;

FIG. 3 is a cross sectional view taken along the line III—III of FIG. 2;

FIG. 4 is a cross sectional view taken along the line IV—IV of FIG. 3;

FIG. 5 is a cross sectional view taken generally along the line V—V of FIG. 1;

FIG. 6 is a cross sectional view taken along the line VI—VI of FIG. 2;

FIG. 7 is a cross sectional view taken along the line VII—VII of FIG. 6;

BRIEF DESCRIPTION OF THE PREFERRED EMBODIMENTS

Figures 8, 9:
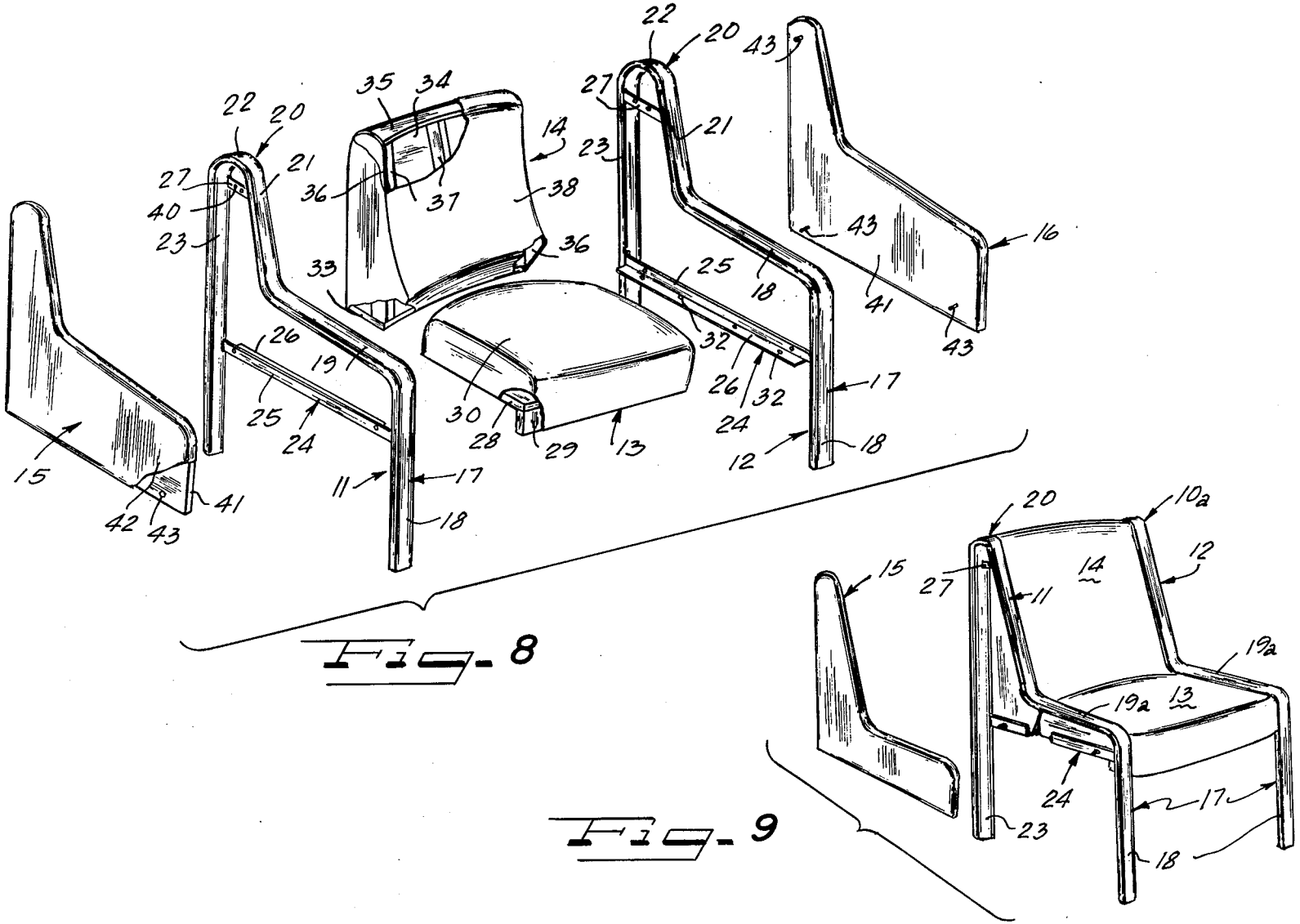
FIG. 8 is an exploded perspective view of the components of the chair of FIGS. 1 to 7.
FIG. 9 is an exploded perspective view of a modified chair and end panel of this invention.

As shown in FIG. 1, a chair 10 of this invention is composed of a left end frame module 11, a right end frame module 12, a seat module 13, a back module 14, a left end panel module 15 and a right end panel module 16.

Each end frame module 11 and 12 is composed of a bent metal tube 17, preferably of oval cross section and chrome plated or otherwise finished to a desired texture and color.

As shown in FIGS. 1 and 3, each tube 17 is bent to provide an upright front leg portion 18, a substantially horizontal arm portion 19 and an upstanding U-shaped portion 20 having a front sloping leg 21 extending upwardly from the rear end of the arm portion 19, a top bight portion 22 and a vertical rear leg 23 extending from the bight portion 22 to terminate level with the front leg 18.

As best shown in FIGS. 2, 3, 7 and 8, a metal angle strip 24 spans the space between the front leg 18 and the rear leg 23 below the arm rest portion 19 of each bent tube 17 and is welded at its ends to the legs, preferably at the inner faces thereof. In the end frame module 11, the angle strip 24 has an upstanding leg 25 positioned to receive the panel module 15 thereagainst and an inwardly projecting leg 26 forming a ledge projecting to the right for supporting the lefthand ends of the seat module 13 and the back module 14 as will be more fully hereinafter described. However, in the end frame module 12, the angle strip 24 has its leg 26 projecting to the left to form a ledge supporting the righthand ends of the seat and back modules.

The U-shaped portion 20 of each end frame module 11 and 12 has a metal bracket strip 27 spanning the legs 21 and 23 under the bight portion 22 and welded at its ends to these legs at the inner faces of the legs.

Thus, the module 11 is a mirror image of the module 12 and is formed from identical components.

The seat module 13 has a wood frame including a flat bottom board 28 and a depending front strip 29 terminating inwardly from the side edges of the board 28.

The wood frame of the seat module 13 is upholstered providing a cushion 30 covering the board 28 and the front face of the strip 28. Cushion material, such as foam resin, padding, springs and the like can be used under the covering fabric, as desired.

The sides edges of the board 28 rest on the legs 26 of the angle strips 24 and fasteners such as screws 31 project through holes 32 in the legs 26 to be threaded into the board 28 for rigidly affixing the seat module 13 to the end frame modules 11 and 12. As shown in FIGS. 2 and 7, the side edges of the board 28 fit snugly in the upstanding legs 26 of the angle strips 24.

The back module 14 has a wood frame with a base board 33, an upstanding back wall 34, a top wall 35, end walls 36, and a plurality of ribs or slats 37 between the end walls 36 extending from the bottom 33 to the top 35 and contoured to form a curved back rest support for upholstery 38 covering the module. As in the seat module 13, the upholstery can include any cushion material covered by a fabric, leather or the like.

The end boards 36 fit snugly between the side legs 21 and 23 of the U-shaped tube portion 20 against the bracket strips 27 as shown in FIG. 5 and fasteners such as screws 39 project through holes 40 in the strips 27 and are threaded through the board 26 into the end ribs 37.

The bottom board 33 rests on the legs 26 of the angle strips 24 as shown in FIG. 3 and the same type fasteners 31 used to secure the bottom board 28 of the seat module 13 to the legs are also used to secure the bottom board 33 to the angle strips.

The end panel modules 15 and 16 are each composed of a board 41 which can be wood or metal and these boards can be finished or covered with upholstery and padding 42 as desired. The upholstered panels are shaped and sized to fit in the tubing section 17 of the end frame modules 11 and 12 and fasteners 43 secure the panel to the upstanding legs 25 of the angle strips 24 and to the brackets 27. These fasteners can be hidden or blind such as snap fasteners or dowel pins fitting in holes in the legs 25 of the angle strips 24 and in the brackets 27. The end panel modules 15 and 16, like the end frame modules 11 and 12, are mirror images.

As shown in FIG. 9, a modified chair **10*a* is composed of the same modules as the chair 10 but the tubing 17 of the end frame modules 11 and 12 is bent so that the arm rest portions 19 of the chair 10 are flush with the seat module 13 as shown at 19*a* and the end panel modules 15, 16 are shaped to fit within the modified contour of the tubing 17. The tubing provides the same legs 18 and 23, and the same U-shaped portion 20 as in the chair 10**.

From the above descriptions, it will be understood that the modules 11–16 can be stacked flat and shipped in a compact package for easy assembly with the simple fasteners 31, 39 and 43 at the point of use or display while the end panel modules 15 and 16 and the seat and back modules 13 and 14 can be furnished in different finishes for selection by the customer to assemble a chair of his choice.

It will be also understood that while the drawings illustrate chairs as the preferred embodiment of the invention, the invention is not limited to the particular shapes or contours illustrated in the drawings and the principles of this invention also extend to many articles of furniture such as davenports, benches, love seats and the like.

I claim as my invention:

1. An article of furniture comprising a pair of laterally spaced tubular metal end frames each having front and rear legs connected by an upright looped back portion and a forwardly extending substantially horizontal portion, an angle strip secured at its ends to the leg portions of each end frame spanning the space between the leg portions below the horizontal portion and having one of its legs projecting toward the other end frame to provide a support ledge, a seat unit spanning the space between the end frames resting on and secured to the ledges of said angle strips, a back unit spanning the space between the end frames resting on and secured to the ledges of said angle strips rearwardly from the seat unit, brackets secured to the upright looped back portion near the top thereof, fasteners securing the upper portions of the back unit to said brackets, and end panel units fitting in the tubular metal end frames secured to said angle strips and brackets.

2. An article of furniture composed of individual modules adapted to be assembled in side by side relation which comprises end frames each having front and rear legs, an upright back portion, and a substantially horizontal portion connecting the front legs with the back portion, a rigid angle strip secured at its ends to the front and rear legs of each frame and spanning the space therebetween at a level below the horizontal portion thereof, said angle strips having inwardly facing support ledges under the horizontal portions connecting the back and leg portions, back and seat modules resting on and secured to said ledges, panels nested in the end frames providing finished ends for the article of furniture, and fasteners securing the panels to the angle strips.

3. A chair comprising end frame modules, a back module, a seat module, said modules having rigid frames with base boards, ledges on the end frame modules supporting the base boards of the back and seat modules, and fasteners anchoring the base boards of the seat and back modules on said ledges.

4. The article of furniture of claim 1 wherein each of said units is finished individually for selective attachment to the end frames.

5. The article of furniture of claim 1 wherein the back and seat units have rigid frames with bottoms resting on the ledges.

6. The article of furniture of claim 1 wherein the horizontal portions of the end frames form arm rests above the seat unit.

7. The article of furniture of claim 1 wherein the horizontal portions of the end frames are substantially level with the top of the seat unit.

8. The article of furniture of claim 1 wherein each of the frames and units are substantially flat and are adapted to be stacked for shipment in a compact package for assembly at the point of delivery.

9. The article of furniture of claim 1 wherein the seat unit has a frame composed of a top board, a back board, a bottom board, ribs connecting the top and bottom boards, and end boards secured to the ribs.

10. The article of furniture of claim 2 wherein the back module, the seat module and the panels are upholstered.

11. The article of furniture of claim 2 wherein the end frames are bent tubes with inverted U-shaped tops.

12. The article of furniture of claim 11 including brackets in the U-shaped tops and fasteners securing the top of the back module to said brackets.

13. The article of furniture of claim 2 wherein the modules are easily assembled by screws at the point of use.

14. The article of furniture of claim 2 wherein the panels are secured to the end frames by blind fasteners.

15. The chair of claim 3 wherein the end frame modules are bent tubing having upstanding front and rear legs, an inverted U-shaped back and a portion joining the front leg with the back.

16. The chair of claim 15 wherein said portion is an arm rest.

17. The chair of claim 15 wherein said portion is substantially flush with the top of the seat module.

18. The chair of claim 3 wherein the ledges are legs of angle strips.

19. The chair of claim 3 including end panel modules secured to the end frame modules.

20. The chair of claim 19 wherein the end frame modules are bent tubing and the panel modules are nested therein.

* * * * *